United States Patent [19]

Kraus

[11] Patent Number: 4,746,311

[45] Date of Patent: May 24, 1988

[54] STEERING DRIVE SYSTEM FOR ELECTRIC FISHING MOTORS

[75] Inventor: Tom J. Kraus, Sherrill, Iowa

[73] Assignee: The Eska Company, Dubuque, Iowa

[21] Appl. No.: 885,859

[22] Filed: Jul. 15, 1986

[51] Int. Cl.[4] ..... B63H 21/17

[52] U.S. Cl. ..... 440/6; 114/144 E; 74/480 B

[58] Field of Search ..... 114/144 R, 144 E; 440/1, 2, 6, 7, 84; 74/480 B

[56] References Cited

U.S. PATENT DOCUMENTS

| | | | |
|---|---|---|---|
| 2,877,733 | 3/1959 | Harris | 440/58 |
| 3,865,335 | 2/1975 | Roller | 440/6 |
| 3,989,000 | 11/1976 | Foley | 440/6 |
| 4,005,674 | 2/1977 | Davis | 440/1 |
| 4,610,632 | 9/1986 | Osborne | 440/6 |
| 4,614,900 | 9/1986 | Young | 114/144 E |

*Primary Examiner*—Joseph F. Peters, Jr.
*Assistant Examiner*—Stephen P. Avila
*Attorney, Agent, or Firm*—James C. Nemmers

[57] ABSTRACT

A steering drive system for electric fishing motors of the type having a motor-propeller assembly supported at the lower end of a motor tube. The motor tube is driven through a friction drive arrangement by a steering gear that is rotated through a gear train by a steering drive motor. To limit the rotation of the steering gear, and thus limit the rotation of the motor-propeller assembly, a limit switch is triggered by a simple actuator driven also by the steering gear. The unique arrangement permits the motor-propeller assembly to be turned through a full range whether in forward or reverse without use of complicated gears, belts or chains.

6 Claims, 3 Drawing Sheets

10
20
34
38
40
32
30
36
24
43
58
56
46
60
44
42
50
52
22

STEERING DRIVE SYSTEM FOR ELECTRIC FISHING MOTORS

BACKGROUND OF THE INVENTION

Most outboard motors, including the electric motors customarily used for trolling, are also used to steer the boat by turning the motor itself. In the case of electric fishing motors, a motor-propeller assembly is supported at the bottom of a turnable motor tube so that turning the motor-propeller assembly will steer the boat. Usually, the steering function is done manually, the units being provided with a control housing at the upper end of the motor tube which has a control handle that is used to control speed and which can also be used to steer the boat. In some instances, the steering function can be performed from a remote location using a cable or linkage system. An example of such a remote steering system is shown in U.S. Pat. No. 4,565,529 issued to Aertker et al. There are obvious disadvantages to the manual system since the operator must sit near the bow of the boat (if the motor is bow-mounted) and operate the controls. Remote systems such as the one shown and described in the foregoing identified U.S. Pat. No. 4,565,529 permit the operator to be located at various positions throughout the boat, and most remote systems utilize foot controls to free the hands of the operator for fishing. However, known remote systems, including those of the type shown in the Aertker et al patent previously referred to, are relatively complicated and require the use of cables or other linkage to turn the motor tube in order to steer the boat.

In the co-pending patent application of James R. Edwards, U.S. Ser. No. 886,517, filed July 16, 1986 entitled "Friction Steering Drive System For Electric Fishing Motors" there is described a steering drive system which utilizes a steering drive motor and gear train that drives a steering gear having a friction drive hub through which the motor tube extends. Thus, when the steering drive motor is actuated, the steering drive gear will turn at a predetermined speed and thus turn the motor tube through the friction drive. For a friction drive system of this and similar types, it is necessary to limit the rotation of the steering gear so that the operator will not inadvertently maintain the power to the steering drive motor and cause the steering gear to continue to rotate in one direction causing the battery cable to wrap around the motor tube and limit the steering or damage the battery cable. There is therefore a need for a control for limiting the movement of the steering gear while still permitting a wide range of turning in both forward and reverse.

SUMMARY OF THE INVENTION

The invention utilizes a single limit switch to detect rotation of the steering gear greater than 360° but less than 720°. This is accomplished by forming a driving rib on the steering gear that engages a simple actuator that is basically an annular ring through which the motor tube extends, the ring having a switch actuator extending outwardly from it. The switch actuator will engage a limit switch, but because of the design of the driving rib on the steering gear and the actuating ring, rotation through 540° is allowed to provide a full range of steering in either direction.

DESCRIPTION OF THE PREFERRED EMBODIMENT OF THE INVENTION

Figure 1:
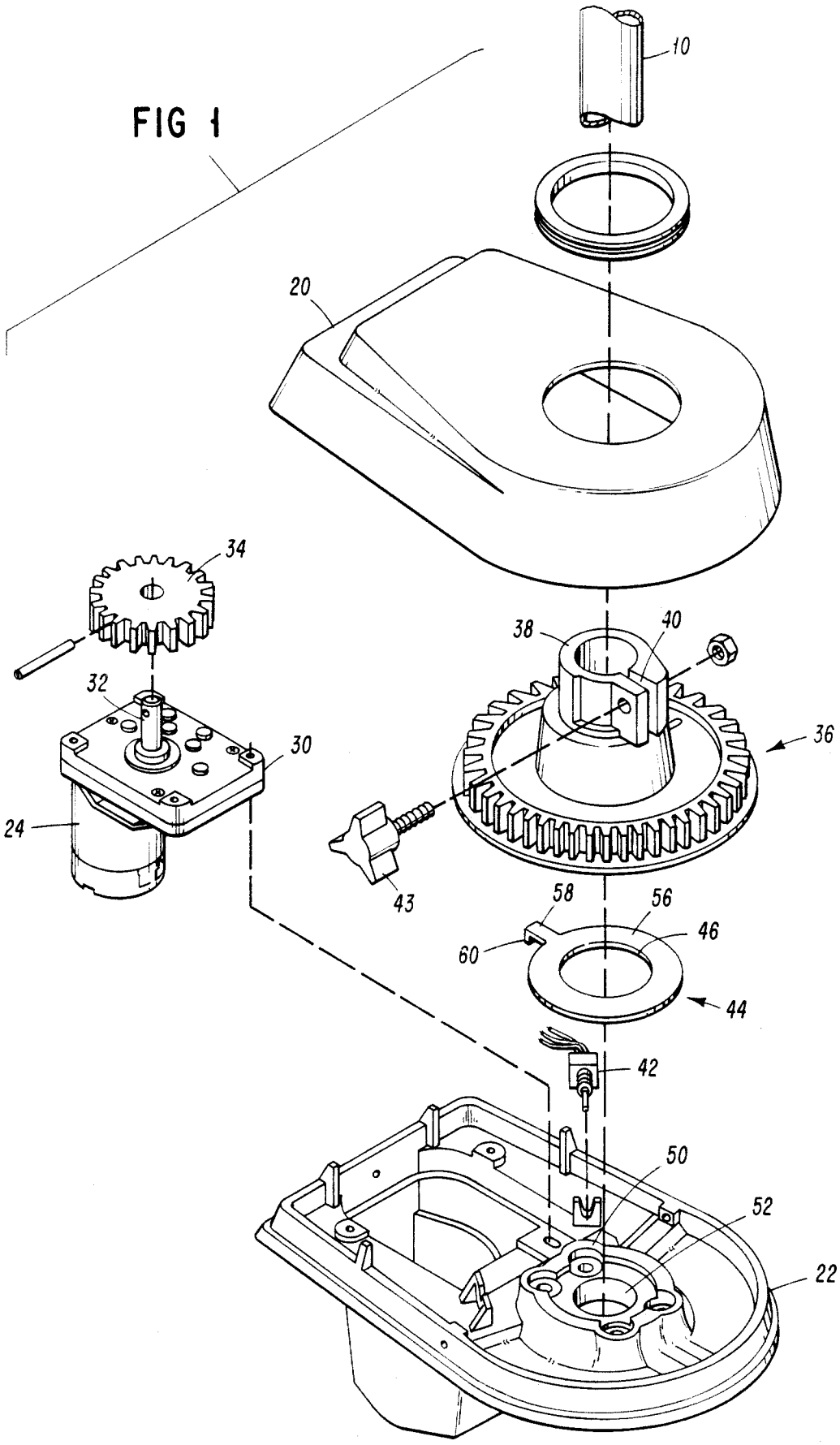
FIG. 1 is an exploded perspective view illustrating the steering drive system of the invention.

As is well known to those skilled in the art, an electric fishing motor includes a motor-propeller assembly (not shown) positioned at the lower end of a motor tube indicated on the drawings by the reference numeral 10. The motor tube extends vertically through a swivel bracket 12 that is in turn releasably connected to the mounting assembly 14 secured to the boat (See FIG. 2). A suitable mounting assembly is shown in James R. Edwards co-pending U.S. patent application Ser. No. 884,534, filed July 11, 1986 entitled "Quick Release Assembly For Electric Trolling Motors". However, the steering drive system shown and described herein as my invention is not limited in its application to mounting assemblies of that type, but it is readily usable with any mounting assembly.

Secured to the top of the swivel bracket 12 is a steering drive housing assembly indicated generally by the reference numeral 16. Housing assembly 16 is secured to the swivel bracket by suitable fasteners such as threaded members 18, and housing assembly 16 preferably includes a removable cover 20 secured to the main body 22 of housing assembly 16. Preferably, the housing assembly 16 is constructed so as to be water-resistant, and the design illustrated in the drawings is so constructed.

Contained within housing assembly 16 is a steering drive motor 24. Motor 24 is an electric motor and is reversible, the motor receiving its power through connection to a storage battery (not shown) which may also be used to power the electric trolling motor or a separate battery may be used. Connection of the drive motor 24 with the storage battery is usually done through a wired connection (not shown) that also contains the control wires carrying the signals to stop, start and reverse the motor 24. A wireless remote control system for accomplishing such control is described in my co-pending U.S. patent application Ser. No. 890,009, filed July 24, 1986 entitled "Wireless Remote Control System For Trolling Motors". However, it should be understood that any suitable control systems may be utilized, including wireless and wired remote systems, to control the operation of the steering drive motor 24.

Through a gear box 30, an output shaft 32 is driven, which shaft 32 is operatively connected to a small spur gear 34 that is engaged with and drives a larger spur steering gear indicated generally by the reference numeral 36. The speed of the motor 24 and the size and design of the various gears are such that the steering gear 36 is driven at a very low R.P.M. The larger spur gear 36 has a drive hub 38 through which the motor tube extends. The drive hub 38 is slotted as at 40 with the slotted portion 40 having a threaded member 43 which can be tightened or loosened so as to vary the amount of friction grip of the drive hub 38 on the motor tube 10. Although a gear drive has been shown and described in this preferred embodiment, a belt, preferably a cog belt, or a chain drive could be employed to drive hub 38.

With the system described, the operator can stop, start and reverse the steering drive motor 24 so as to steer the boat either in forward or reverse through an unlimited range of turning. However, since the operator cannot see the submerged motor-propeller assembly that steers the boat, it is desirable to have a limit on the degree of rotation. Presently what is used is an indicator of some design to show the direction of propeller rotation. However, no limit on the amount of steering is provided in power steering designs.

Positioned in the housing assembly 16 beneath the steering gear 36 is a double acting limit switch 42. An annular actuating ring 44 has a central opening 46 of a sufficient size to permit the bottom hub 48 of the steering gear 36 to extend through the actuating ring 44. As best seen in FIG. 1, the actuating ring 44 is positioned beneath the teeth of the steering gear 36, but it is positioned so that it rides on an annular shoulder 50 surrounding the opening 52 in the main body 22 of housing assembly 16.

Figure 4:
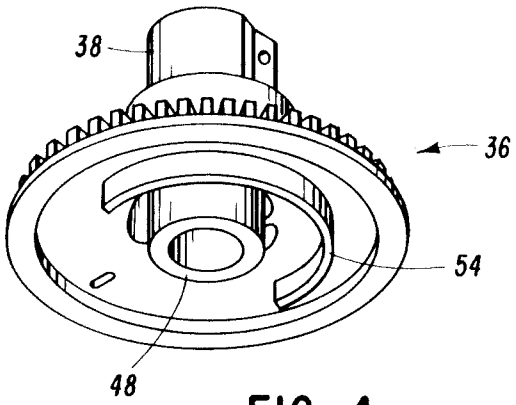
FIG. 4 is a perspective view of the under side of the steering gear illustrating the drive mechanism.
Figure 2:
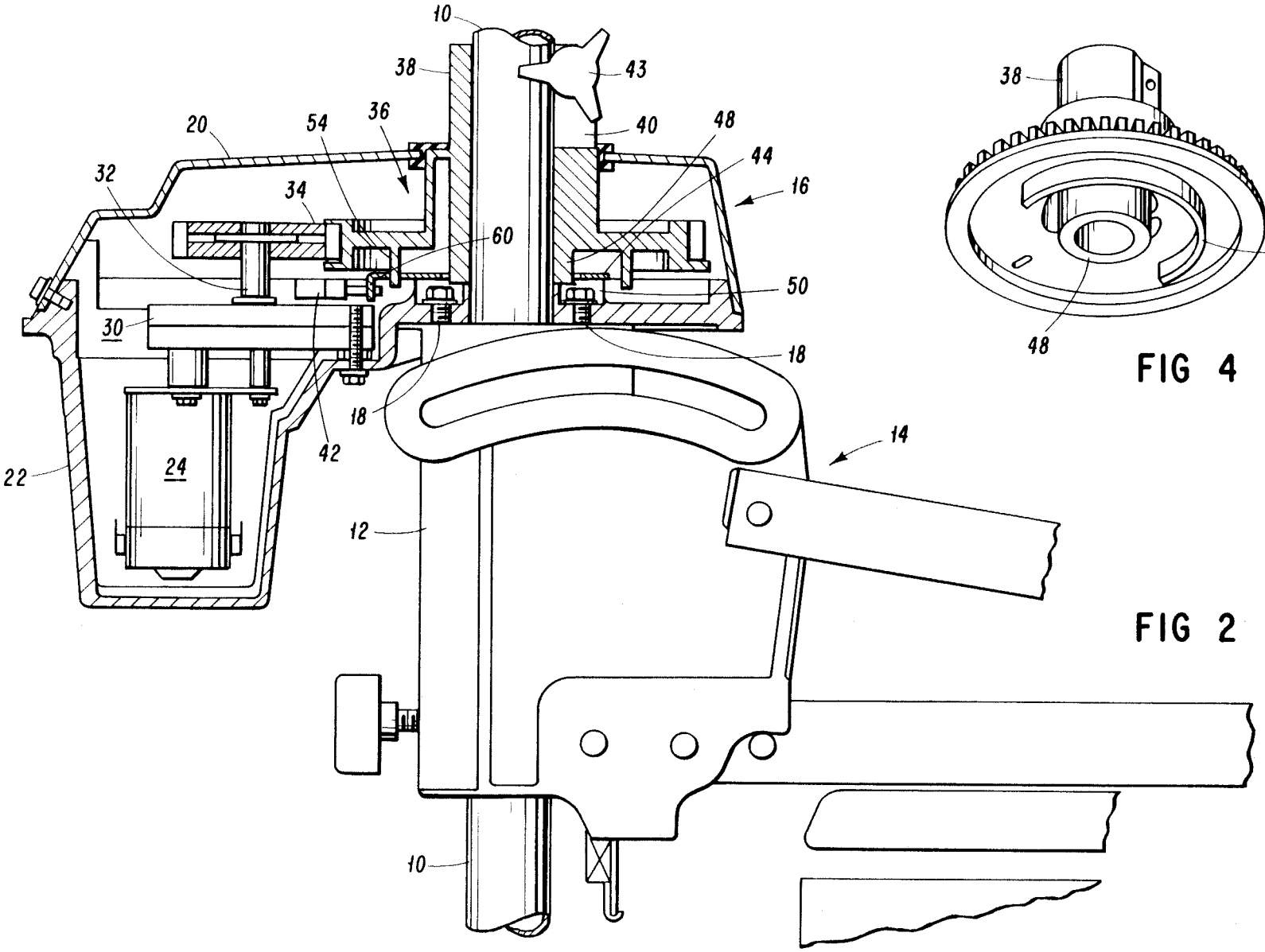
FIG. 2 is a side elevational view, partly in section, and showing the steering drive system in an assembled condition on the mounting bracket for the motor.
Figure 3:
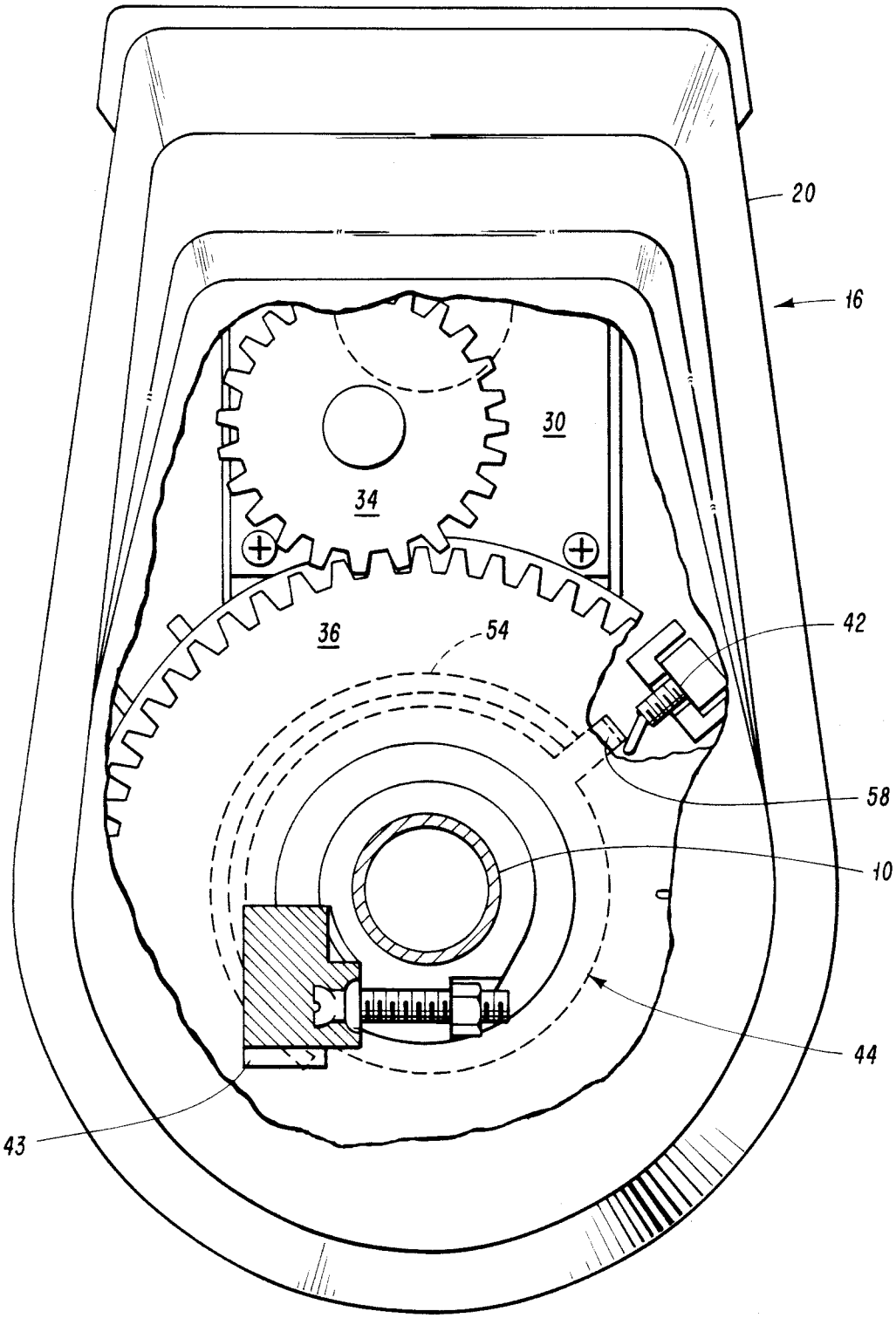
FIG. 3 is a top plan view of the assembled steering drive system with a portion of the housing broken away and a portion of the view in section to more clearly illustrate the functioning of the drive system.

The steering gear 36 is provided with an arcuate drive member 54 which is formed on the lower surface of the gear 36 as best seen in FIG. 4. As best seen in FIG. 3, this arcuate drive member extends to an arc of slightly less than 180°. The arcuate drive member 54 is positioned radially outwardly from the axis of the steering gear 36 a sufficient distance to clear the annular portion 56 of the actuating ring 44. The actuating ring is provided with an actuator 58 that extends radially outwardly and has a downwardly extending lip 60. As best seen in FIGS. 2 and 3, the limit switch 42 extends in the path of the actuator 58 so that the lip 60 will engage and trip the switch 42.

Thus, as the steering gear 36 rotates, the drive member 54 will engage the actuator 58 and rotate the actuating ring 44 until the lip 60 of actuator 58 engages the limit switch 42 at which time the limit switch is activated. Because the drive member 54 extends through an arc of only 180°, the steering gear can rotate 180° before it engages the actuator 58 of the actuating ring 44. If the steering gear 36 continues to rotate in the same direction, it will carry the actuating ring with it driving the actuator 58 through an arc of 360°. Thus, the steering gear can actually rotate 540° in each direction before the limit switch 42 will be engaged and activated by the lip 60 of the actuator 58. Obviously, by changing the length of the arc of the drive member 54, the arc of rotation can be varied. The arc of 540° has been selected to permit complete rotation in either direction greater than 360° but less than 720°. The 540° arc selected will permit the trolling motor-propeller assembly automatically to stop perpendicular to the bow mount bracket 12 and thereby ready to be raised to a storage position.

Obviously, by reducing the arcuate length of the drive member 54 on the steering gear 36 to a theoretical 0°, a full range of 720° could be utilized by using only a single limit switch 42. Of course, the limit switch 42 is connected in the electrical control system so as to turn off the steering motor 24 whenever the limit switch 42 is activated regardless of the direction that the steering gear 36 is rotating.

Also, if desired, the contact between lip 60 on actuating ring 56 and limit switch 42 may be provided with an elastomer cushion to prevent damaging limit switch 42 in the event of gear overrun.

It will be evident from the foregoing description that the steering gear drive system of the invention is extremely simple and has few moving parts that need service or repair. The system of the invention eliminates the need for complex gears, belts, chains or other components to accomplish a full range of movement of the steering function while also accomplishing an automatic stop point of the motor-propeller assembly in a position for storage. The operator can thus turn the steering motor on and activate the steering gear in either direction until it is stopped by the limit switch 42. The operator will then know without even looking that the motor-propeller assembly is in a proper position for storage.

Having thus described the invention in connection with the preferred embodiment thereof, it will be evident to those skilled in the art that various revisions and modifications can be made to the preferred embodiment without departing from the spirit and scope of the invention. It is my intention however that all such revisions and modifications as are obvious to those skilled in the art will be included within the scope of the following claims.

What is claimed is:

1. A drive system for steering an electric trolling motor for boats in which the motor assembly is supported at the lower end of a vertical motor tube, said drive system comprising drive means operatively connected to the motor tube for rotating the motor tube to steer the boat, the drive means including a driven member rotatable at the same rate of rotation as the motor tube, a steering motor for driving the drive means, switch means for turning the steering motor off, an actuator intermittently rotatable with the driven member to actuate the switch means, the switch means being located in the path of rotation of the actuator, and means combined with the driven member to rotate the actuator only after the driven member has rotated through a predetermined arc of rotation.

2. The drive system of claim 1 in which the drive means is a gear drive and the driven member is a gear through which the motor tube extends, the drive means also including a drive hub operatively connected to the motor tube and through which the motor tube extends, the drive hub being driven by the gear.

3. A drive system for steering an electric trolling motor for boats in which the motor assembly is supported at the lower end of a vertical motor tube, said drive system comprising a drive gear and a driven gear engaged with the drive gear, a drive hub driven by the driven gear and operatively connected to the motor tube and through which the motor tube extends for rotating the motor tube to steer the boat, the driven gear being rotatable at the same rate of rotation as the motor tube, a steering motor for driving the drive gear, switch means for turning the steering motor off, an actuator including an annular member having a radial projection and through which the motor tube extends, the switch means being located in the path of rotation of the projection on the actuator, an arcuate projection extending downwardly form the driven gear, and the actuator being positioned beneath the gear so that the radial projection on the actuator is engageable by the arcuate projection on the gear whereby the motor tube can rotate through an angle of almost 720° in either direction before the switch means is actuated.

4. The drive system of claim 3 in which the arcuate projection on the driven gear extends through an arc of approximately 180° whereby the switch means will be engaged by the actuator only after rotation of the gear and the motor tube through an arc of 540° in either direction of rotation.

5. The drive system of claim 4 in which the arcuate projection is an integral part of the driven gear.

6. The drive system of claim 5 in which the drive hub, the driven gear and the arcuate projection are formed into a single piece through which the motor tube extends.

* * * * *